US005392493A

United States Patent [19]

Youngdale

[11] Patent Number: 5,392,493

[45] Date of Patent: Feb. 28, 1995

[54] POCKET HINGE ASSEMBLY

[76] Inventor: Louis L. Youngdale, 802 Crescent Dr., Vista, Calif. 92084

[21] Appl. No.: 112,106

[22] Filed: Aug. 26, 1993

[51] Int. Cl.[6] ..... E05D 7/04

[52] U.S. Cl. ..... 16/237; 16/321

[58] Field of Search ..... 16/232, 235, 236, 237, 16/238, 277, 278, 291, 296, 297, 319, 321, 335, 247

[56] References Cited

U.S. PATENT DOCUMENTS

| | | | |
|---|---|---|---|
| 3,203,031 | 8/1965 | Youngdale et al. | 16/321 |
| 3,623,185 | 11/1971 | Cartwright et al. | 16/335 |
| 3,931,663 | 1/1976 | Holmes et al. | 16/238 |
| 4,177,540 | 12/1979 | Gorton | 16/237 |
| 4,240,179 | 12/1980 | Lautenschlager, Jr. | 16/321 |
| 4,359,803 | 11/1982 | Lautenschlager | 16/335 |
| 4,422,214 | 12/1983 | Lautenschlager et al. | 16/291 |
| 4,493,129 | 1/1985 | Grass | 16/238 |
| 4,502,182 | 3/1985 | Lautenschlager et al. | 16/291 |
| 4,506,409 | 3/1985 | Lautenschlager | 16/238 |
| 4,509,229 | 4/1985 | Salice | 16/327 |
| 4,604,769 | 8/1986 | Rock et al. | 16/238 |
| 4,675,941 | 1/1987 | Grass | 16/295 |
| 4,716,622 | 1/1988 | De Bruyn | 16/297 |
| 4,800,624 | 1/1989 | Whitefoot et al. | 16/335 |
| 4,873,743 | 10/1989 | Toyama | 16/237 |
| 5,027,474 | 7/1991 | Bowers | 16/297 |
| 5,060,344 | 10/1991 | Cress | 16/335 |

FOREIGN PATENT DOCUMENTS

| | | |
|---|---|---|
| 2648095 | 4/1978 | Germany . |
| 2189291 | 10/1987 | United Kingdom . |

*Primary Examiner*—P. Austin Bradley
*Assistant Examiner*—Chuck Y. Mah
*Attorney, Agent, or Firm*—Hawes & Fischer

[57] ABSTRACT

A pocket hinge assembly having a cabinet plate mounted inside a cabinet, a cup mounted within a receptacle formed in a cabinet door, and a linking member that pivotally connects the cabinet plate to the cup to permit the cup to rotate relative to the cabinet plate and the cabinet door to move between open and closed positions relative to the cabinet. A first end of the linking member is coupled to the cup at a pivot extending therethrough such that the cup is rotatable relative to the cabinet plate at the pivot pin. The opposite end of the linking member is adjustably connected to the cabinet plate to correspondingly vary the overlay between the cabinet and the door in the closed position. A one-piece locking spring is carried by the cup so as to cooperate with a cam surface projecting from the linking member as the cup rotates towards the cabinet plate and the cabinet door moves to a closed position across the cabinet to thereby form a lock for preventing the cup from rotating away from the cabinet plate and the cabinet door from moving out of the closed position.

17 Claims, 7 Drawing Sheets

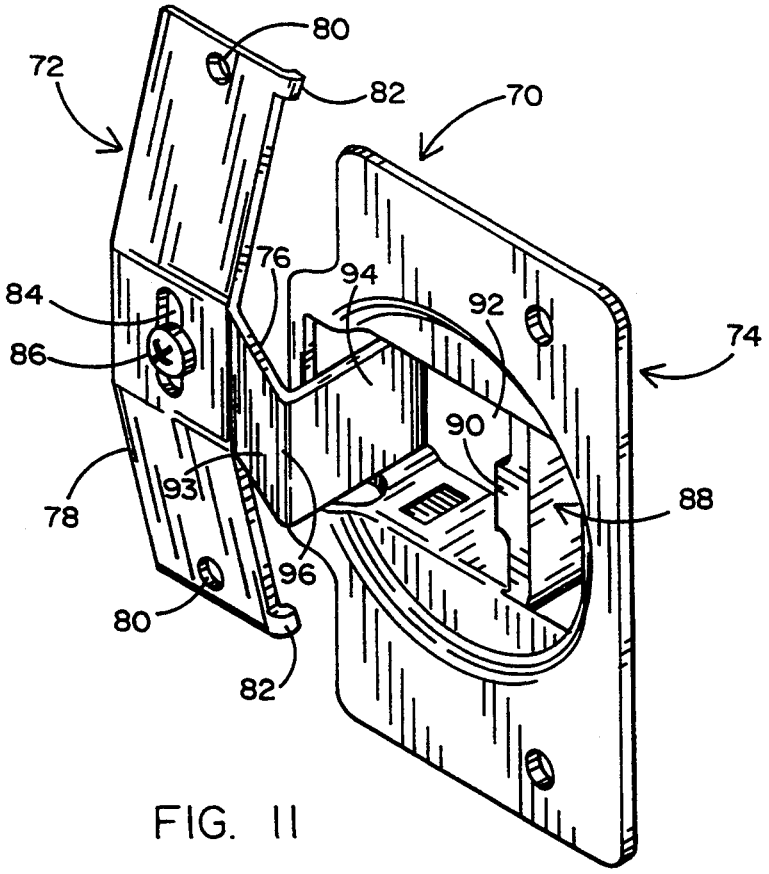
FIG. 11
FIG. 12
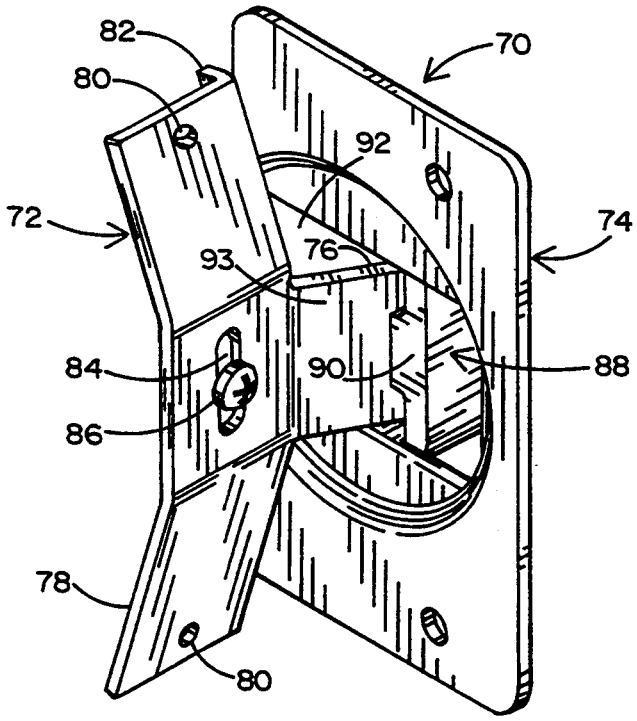

POCKET HINGE ASSEMBLY

BACKGROUND OF THE INVENTION

1. Field of the Invention

This invention relates to unique pocket hinge assemblies which, when installed, permit a cabinet door to rotate between open and closed positions relative to an associated cabinet. The pocket hinge assemblies advantageously include a positive locking feature by which to reliably maintain the door in the closed position across the cabinet.

2. Background Art

Pocket hinge assemblies have long been known in the cabinet hinge art for permitting a cabinet door to rotate between open and closed positions relative to an associated cabinet. Such pocket hinge assemblies usually include a cabinet plate member or bracket that is fixed to a wall of a cabinet and a cup member or pot that is pivotally interconnected with the cabinet plate member and affixed to the cabinet door. The cup member is typically mounted at the door within a pocket or similar receptacle formed therein.

One problem common to the conventional pocket hinge assemblies is their inability to reliably retain the door in a fully closed position across the cabinet. That is to say, the door may tend to rotate away from the cabinet to a partially open position. This condition is sometimes unattractive and subjects the interior of the cabinet to exposure. By way of another common problem, it is often difficult or inconvenient to adjust the location of the cup member relative to the cabinet plate member depending upon the amount of overlay desired between the cabinet and its door. More particularly, the installer usually needs both hands to make the adjustments necessary to change the overlay characteristics of the pocket hinge assembly. As a consequence of the foregoing, the installer is denied the availability of a free hand to support the cabinet door during the installation process. Therefore, the installation or adjustment of the door can become a relatively cumbersome and time consuming task.

One example of a known pocket hinge assembly is available by referring to U.S. Pat. No. 4,509,229 to Salice which shows a cam surface formed at a slider and rotatable with a pot-shaped member on a cabinet door into releasable engagement with an end portion of a hinge bracket on a cabinet. However, unlike the claimed invention, the slider of Salice is stiff and not the same as or equivalent to a normally relaxed spring that is adapted to flex in response to an impact force applied thereto.

SUMMARY OF THE INVENTION

Briefly and in general terms, a pocket hinge assembly is disclosed according to one embodiment comprising a cabinet plate mounted inside a cabinet, a cup mounted within a pocket formed in a cabinet door, and a link that pivotally connects the cabinet plate to the cup to permit the cup and the cabinet door connected thereto to rotate between open and closed positions relative to the cabinet. More particularly, one end of the link includes a cylindrical coupler that surrounds a pivot pin of the cup to permit the cup to rotate relative to the cabinet plate. The opposite end of the link includes a slider, the position of which is adjustable along a longitudinally extending channel of the cabinet plate to control the amount of overlay between the cabinet door and the cabinet. A cam surface projects from the approximate mid-point of the link between the first and opposite ends thereof.

A one-piece, hard plastic (e.g. Delrin) normally relaxed spring is carried between a pair of side walls within a cavity of the cup of the hinge assembly. The spring is generally C-shaped having a flat body and a pair of opposing legs which bend towards one another. The legs are fixedly retained by the side walls of the cup while the body is adapted to flex in response to a pushing force applied thereto. To this end, an integral catch is formed on the spring body to receive the pushing force thereagainst.

In operation, the cabinet door is rotated from the open to the closed position relative to the cabinet to correspondingly rotate the cup of the pocket hinge assembly towards the cabinet plate. Accordingly, the catch on the body of the spring will be moved into engagement with the cam surface which projects from the link to cause the spring body to flex in response to the impact of the cam surface against the catch. As the cup of the hinge assembly is closed against the cabinet plate, the catch of the spring will ride over and past the cam surface of the link, such that the spring body will return to its normal, relaxed condition and the catch will snap into releasable engagement with the link behind and in contact with the cam surface thereof. The cooperation of the catch and the cam surface provides the presently described pocket hinge assembly with the advantage of a positive locking feature to reliably retain the cabinet door in the closed position relative to the cabinet until the door is rotated towards the open position and the catch of the spring is disengaged from the cam surface of the link.

A pocket hinge assembly according to another embodiment of this invention includes a cup mounted within a pocket formed at a cabinet door and a one-piece cabinet plate having a flexible, spring-like base attached to the cabinet frame and a link coextensively connected with the base at one end and pivotally connected to the cup at the opposite end. The base of the cabinet plate has an arcuate shape so as to be spaced above the cabinet frame to which it is attached. An elongated adjustment slot is formed through the base to receive an adjustment screw for attaching the base to the cabinet frame. The one-piece cabinet plate may be quickly and easily adjusted in two perpendicular directions to compensate for misalignments between the cabinet frame and the cabinet door caused by the door not being square or the wood being warped. More particularly, the adjustment screw may be tightened downwardly against (or loosened upwardly from) the arcuate base of the cabinet plate to flatten the plate against the frame. In addition, the adjustment screw may slide laterally through the adjustment slot in the base of the cabinet plate. By virtue of the foregoing, the cabinet door will be moved into alignment with the cabinet frame by a pocket hinge assembly that is characterized by a reduced number of parts and corresponding cost.

BRIEF DESCRIPTION OF THE DRAWINGS

FIG. 11 is a perspective view of a pocket hinge assembly which forms a second embodiment of the present invention in an open configuration;

FIG. 12 is a perspective view of the pocket hinge assembly of FIG. 11 in a closed condition;

DETAILED DESCRIPTION OF THE INVENTION

Figure 1:
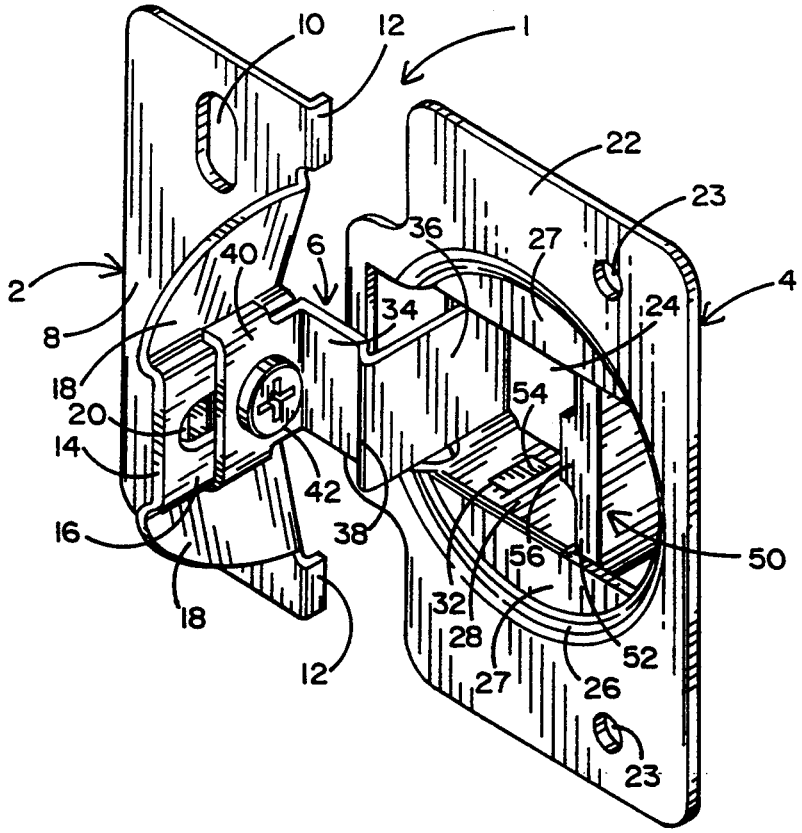
FIG. 1 is a perspective view of a pocket hinge assembly which forms a first embodiment of the present invention in an open condition.
Figure 7:
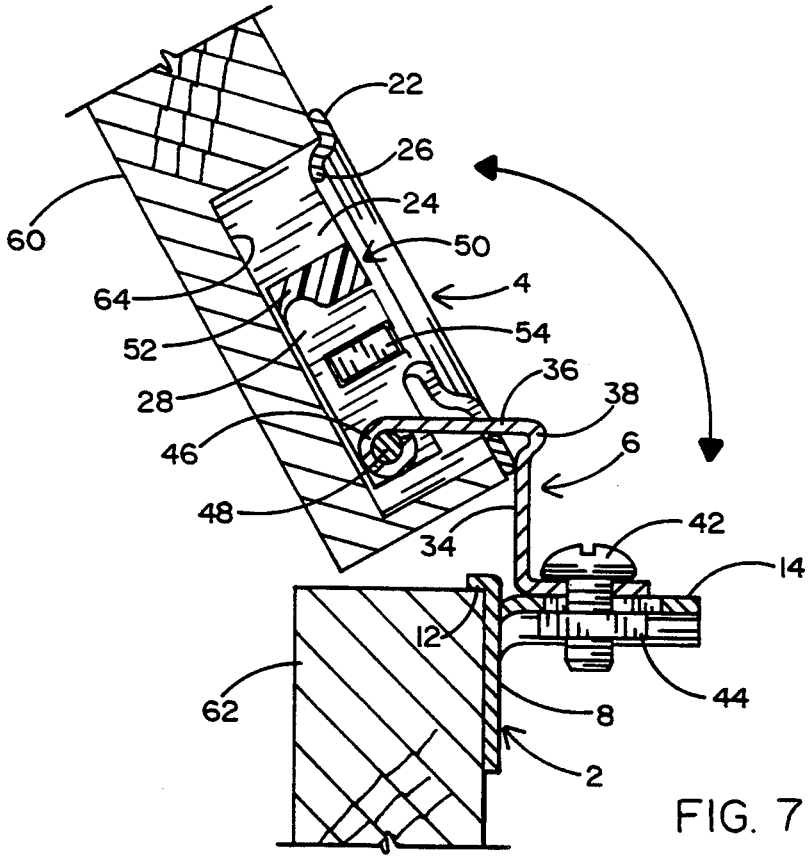
FIG. 7 shows the pocket hinge assembly as installed and rotated to the fully open condition to permit a cabinet door to be opened relative to an associated cabinet.
Figure 8:
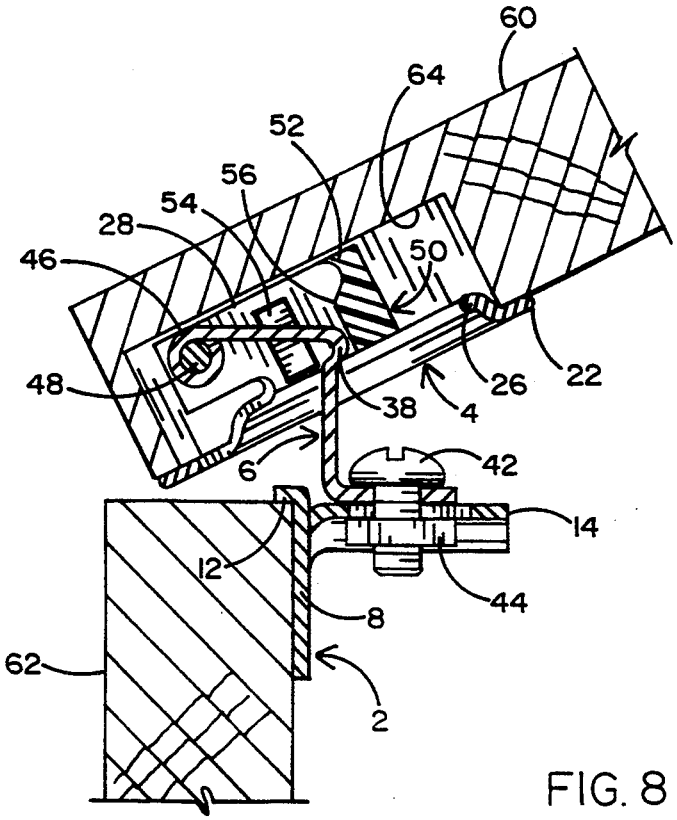
FIGS. 8 and 9 show the pocket hinge assembly as installed and rotated to the partially closed condition to permit the cabinet door to be correspondingly moved towards the closed position relative to the cabinet.

A pocket hinge assembly 1 which forms a first embodiment of the present invention is now described in detail while referring to the drawings, where FIG. 1 shows the hinge assembly in an open condition to permit the door 60 of an associated cabinet 62 to be correspondingly opened (as best shown in FIG. 7) so that access will be available to the interior of the cabinet 62. The pocket hinge assembly 1 includes the combination of a cabinet plate 2 and a cup 4 that are pivotally interconnected with one another by means of a link 6 extending therebetween. As is best shown in FIGS. 7–10 of the drawings, the cabinet plate 2 is mounted on the frame of the cabinet 62, and the cup 4 is mounted within a pocket or similar receptacle 64 formed within the cabinet door 60 so that the door 60 is rotatable between open and closed positions relative to the cabinet 62. The link 6 which extends between the cabinet plate and cup members 2 and 4 of the pocket hinge assembly 1 permits the cabinet door to rotate relative to the frame.

The cabinet plate 2 of hinge assembly 1 has a flat base 8 with a pair of mounting holes 10 located at opposite ends thereof. A pair of gripping teeth 12 bend outwardly in a first direction from the base 8 to surround an inside corner of the cabinet 62 when the pocket hinge assembly 1 is installed in the manner shown in FIGS. 7–10. Coextensively connected to and bending in an opposite direction from the base 8 of cabinet plate 2 is a linking flange 14. The base 8 and linking flange 14 are joined to one another to make an angle of approximately 90 degrees. The linking flange 14 includes a raised channel 16 which extends longitudinally between a pair of outwardly flared wings 18. An adjustment slot 20 runs longitudinally through the channel 16 of linking flange 14. The purpose of adjustment slot 20 relative to the link 6 of pocket hinge assembly 1 will soon be described.

The cup 4 of assembly 1 also includes a generally flat base 22. Base 22 has a pair of mounting holes 23 located at opposite ends thereof. The base 22 of cup 4 and the base 8 of cabinet plate 2 are of substantially identical length, although the base 22 is about twice as wide as the base 8. An open cavity 24 is formed through the center of the base 22 of cup 4. Projecting from the base 22 into the cavity 24 is a pocket defined by a peripheral lip 26. Extending laterally from the lip 26 are a pair of opposing top walls 27. Depending from the top walls 27 into the cavity 24 are a pair of parallel aligned side walls 28.

Figure 6:
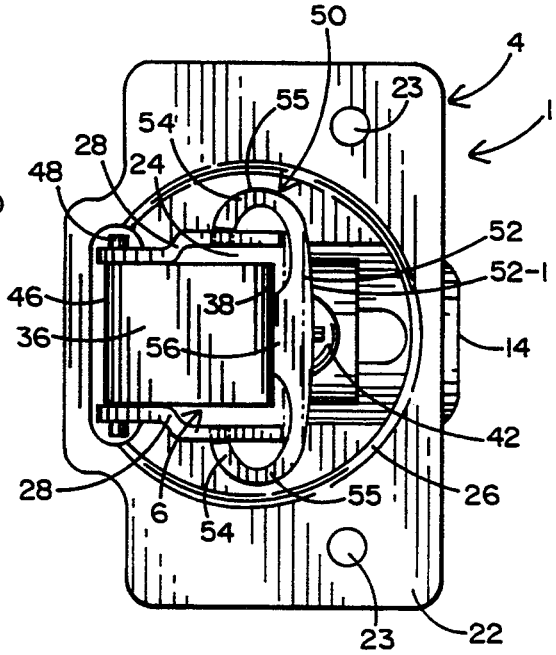
FIG. 6 is a rear view of the pocket hinge assembly in the closed condition showing a one-piece spring that provides the hinge assembly with a positive locking feature.

Retained within the cavity 24 of cup 4 is a one-piece, normally relaxed spring 50. Referring briefly and concurrently now to FIGS. 1 and 6 of the drawings, the one-piece spring 50 is shown having a generally C-shape with a relatively flat body 52 and a pair of curved legs 54 which bend at integral shoulders 55 formed with the body 52. An integral catch 56 is located at the approximate mid-point of the spring body 52. Spring 50 is preferably manufactured from hard plastic (e.g. such as that known commercially as "DELRIN", acetal resin derived by polymerization of formaldehyde having a slightly flexible characteristic. The spring 50 is supported within the cavity 24 of cup 4 by and between the pocket side walls 28. That is, the opposite legs 54 of the C-shaped spring 50 are located below the pocket top walls 27 and received by and fixedly retained at respective slots 32 formed in the pocket side walls 28. Therefore, a pushing force applied to the catch 56 of spring 50 will cause the normally relaxed body (represented by phantom lines and designated by the reference numeral 52 in FIG. 6) to rotate at the shoulders 55, such that the spring body 52 will flex to the stressed position shown in solid lines and designated by the reference numeral 52-1 in FIG. 6. The means for applying the pushing force to the catch 56 for flexing the spring body 52 in response to such pushing force will be described in greater detail hereinafter.

Figure 2:
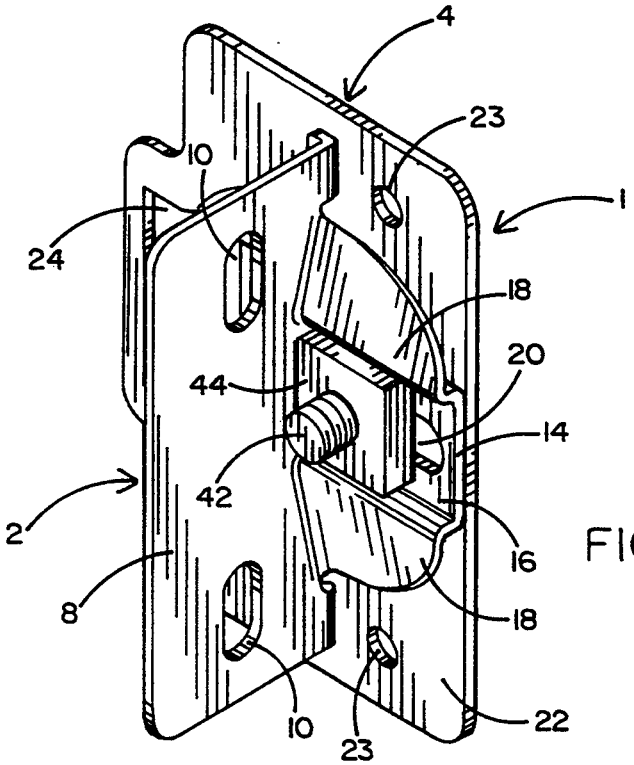
FIG. 2 is a perspective view of the pocket hinge assembly of FIG. 1 in a closed condition.

Referring once again to FIG. 1, the link 6 which pivotally interconnects the cabinet plate 2 with the cup 4 of pocket hinge assembly 1 is shown having first and second swing arms 34 and 36 which are aligned at approximately 90 degrees and coextensively joined together at respective first ends thereof along a laterally extending raised surface which forms a cam 38. Bending away from the opposite end of the first swing arm 34 of link 6 is a slider 40. The slider 40 is aligned parallel with the second swing arm 36 and adapted to be coupled to and slide along the channel 16 of the linking flange 14 of cabinet plate 2. To this end, the slider 40 has an opening for receipt therethrough of a fastener (e.g. a screw 42). When the hinge assembly 1 is installed, the screw 42 which extends through the slider 40 of link 6 will also extend through the adjustment slot 20 in the channel 16 so that the longitudinal position of the slider 40 may be selectively adjusted relative to the linking flange 14 of cabinet plate 2. The position of slider 40 along channel 16 is maintained by means of a complimentary fastener (e.g. a nut 44 of FIG. 2) which is releasably connected to the screw 42 to prevent further displacement of the slider 40.

Figure 10:
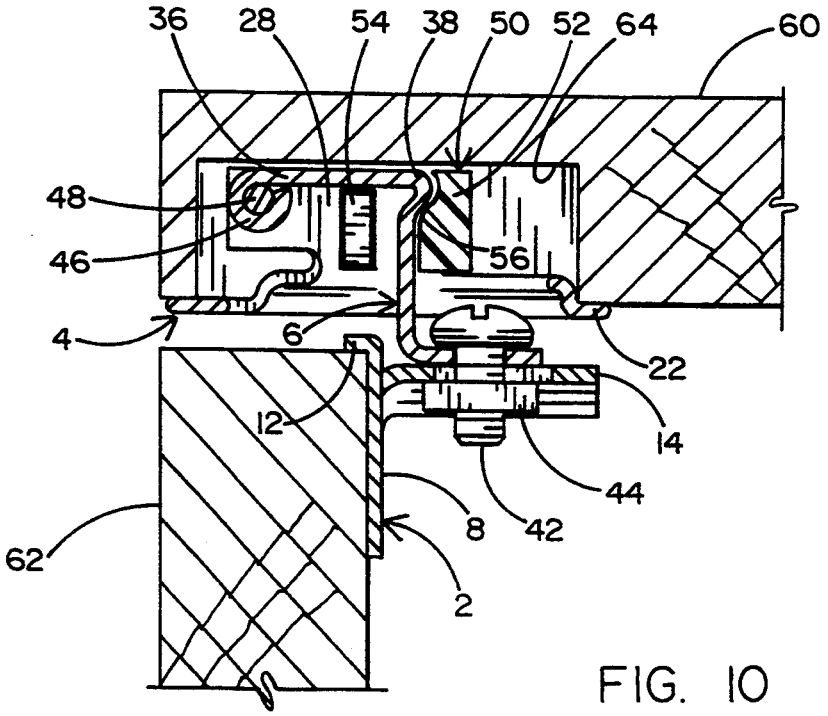
FIG. 10 shows the pocket hinge assembly as installed and rotated to the fully closed condition to permit the cabinet door to be closed across the cabinet.
Figure 13:
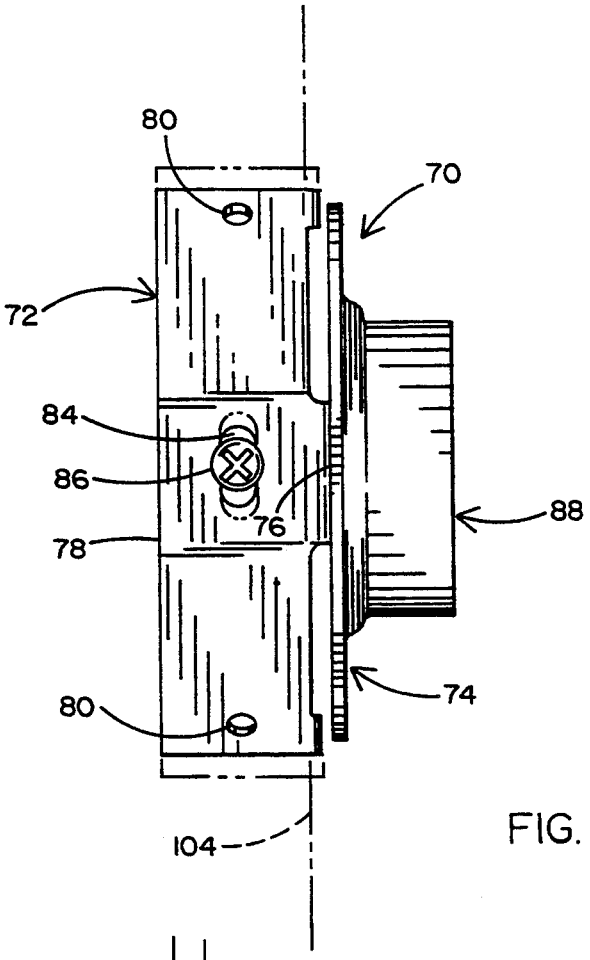
FIG. 13 is a side view of the pocket hinge assembly in the closed condition.
Figure 14:
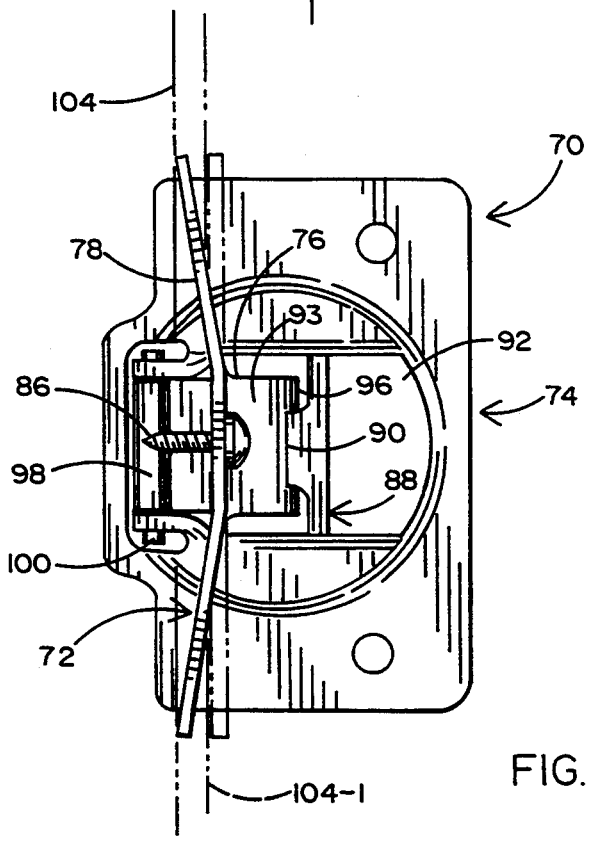
FIG. 14 is a front view of the pocket hinge assembly in the closed condition.

The ability to selectively adjust the position of the slider 40 of link 6 relative to the linking flange 14 of the cabinet plate 2 will permit the distance between the cabinet plate 2 and the cup 4 of pocket hinge assembly 1 to be correspondingly adjusted to likewise allow the amount of overlay between the cabinet door 60 and the cabinet 62 to be changed when the cabinet door is closed across to the cabinet (best shown in FIG. 10). Moreover, the foregoing adjustment may be quickly and easily made with only a single hand to allow the installer use of a free hand to facilitate the adjustment process.

As just described, the first ends of the first and second swing arms 34 and 36 of link 6 are coextensively joined together at the raised cam 38. The opposite end of the second swing arm 36 is bent into a cylindrical coupler 46 that is wrapped around a pivot pin 48 (best shown in FIGS. 7–10). The ends of the pivot pin 48 are fixedly retained within respective openings formed through the pocket side walls 28 such that a rotation of the cup 4 will correspondingly cause the pivot pin 48 to rotate within the coupler 46 of link 6. In this manner, the cabinet door 60, to which the cup 4 of hinge assembly 1 is connected, is rotatable relative to the cabinet 62, to which the cabinet plate 2 is connected, so that the door 60 may swing between open (best shown in FIG. 7) and closed (best shown in FIG. 10) positions.

FIGS. 2–6 of the drawings show the pocket hinge assembly 1 in the closed condition. To move from the open condition of FIG. 1 to the closed condition of FIGS. 2–6, the cup 4 of hinge assembly 1 rotates relative to the cabinet plate 2 from the open configuration, where the base 22 of the cup 4 is aligned at an angle of approximately 210 degrees with the base 8 of cabinet plate 2 (best illustrated in FIG. 7), to the closed configuration, where the bases 8 and 22 of the cabinet plate 2 and the cup 4 are aligned at an angle of approximately 90 degrees (best illustrated in FIG. 10). More particularly, and as has already been disclosed, the pivot pin 48 that is carried by the cup 4 and extends between the pocket side walls 28 rotates within the cylindrical coupler 46 of link 6, whereby cup 4 rotates through an angle of approximately 120 degrees towards the linking flange 14 of cabinet plate 2 (best illustrated in FIGS. 8 and 9).

Figure 9:
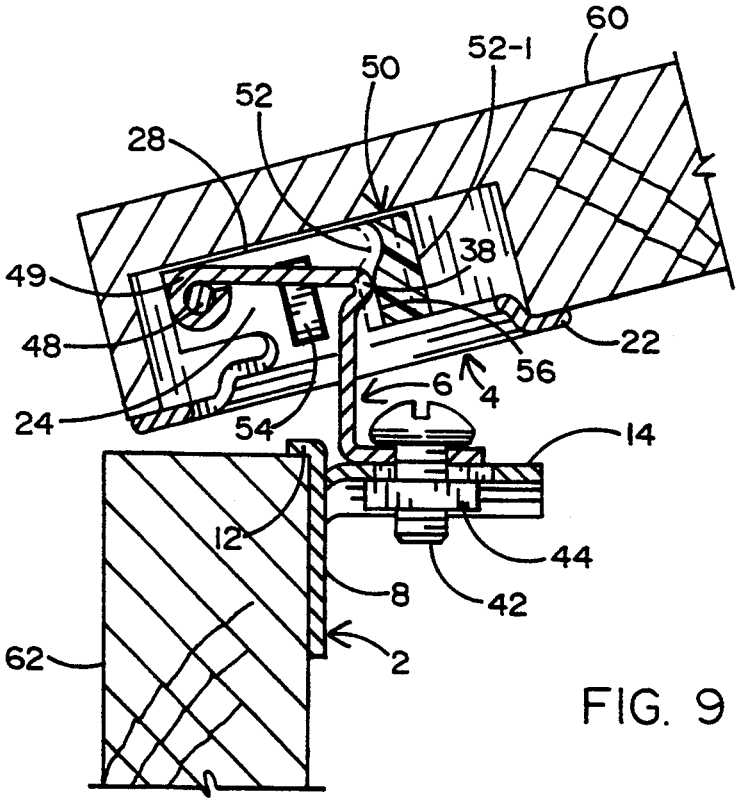

As the cup 4 of hinge assembly 1 rotates towards the linking flange 14 of cabinet plate 2, the link 6 is rotated into the cavity 24 of cup 4. Accordingly, and as is best shown in FIG. 9, the catch 56 of the spring 50 within cavity 24 will be engaged by the cam 38 of link 6. The impact of the catch 56 which projects from the flexible spring body 52 of spring 50 against the cam 38 of link 6 applies the aforementioned pushing force to catch 56. Therefore, with the spring legs 54 fixedly retained at respective pocket side walls 28 of cup 4, the spring body 52 is pushed by cam 38 from its normally unstressed position 52 to its stressed position 52-1.

Figure 3:
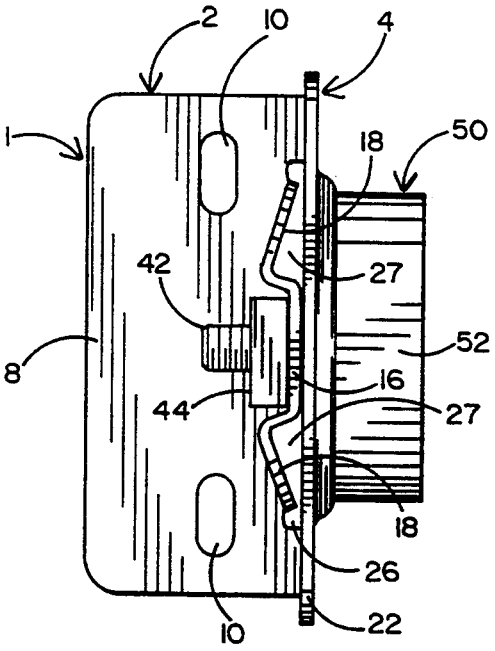
FIG. 3 is a side view of the pocket hinge assembly in the closed condition.
Figure 4:
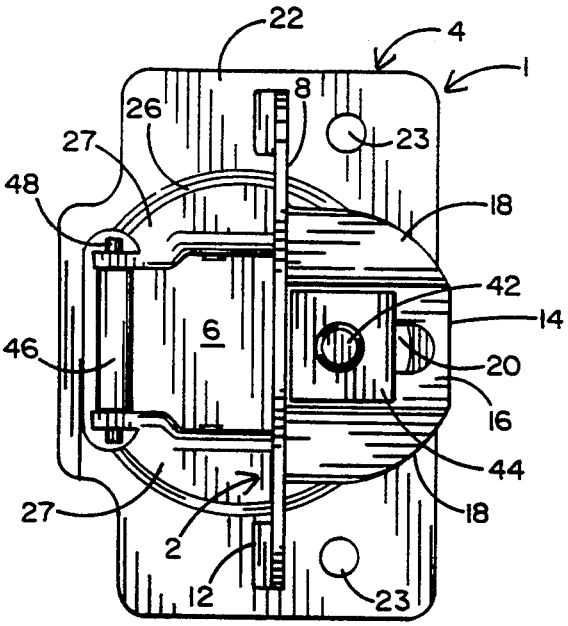
FIG. 4 is a front view of the pocket hinge assembly in the closed condition.
Figure 5:
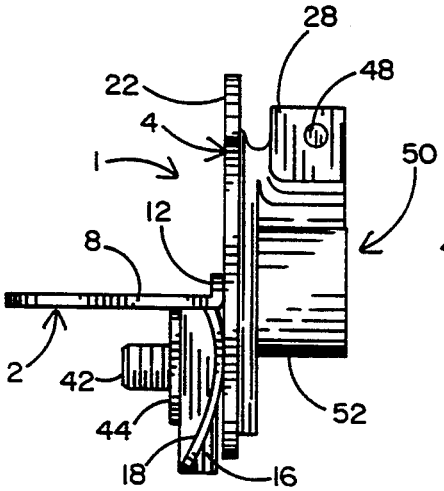
FIG. 5 is a top view of the pocket hinge assembly in the closed condition.

When the pocket hinge assembly 1 is rotated to the fully closed condition, the wings 18 of cabinet plate 2 are seated within the pocket lip 26 and against respective pocket top walls 27 (best shown in FIG. 3). Moreover, the catch 56 of spring body 52 is carried by the cup 4 so as to ride over and past the cam 38 of link 6. Accordingly, the spring 50 will return to its normally relaxed position such that the spring catch 56 will snap into releasable engagement with the swing arm 34 of link 6 immediately behind and in contact with the cam 38 thereof (best shown in FIG. 10).

The cooperation of the cam 38 of link 6 with the catch 56 of spring 50 reliably retains the cabinet door 60 in the closed position across to the cabinet 62 (best shown in FIG. 10). Thus, it may be appreciated that the engagement of the cam 38 with the catch 56 advantageously functions as a positive lock to hold the cabinet door 60 closed. In this regard, the cam 38 and catch 56 may be disengaged from one another by applying a sufficient pulling force to rotate the cabinet door 60 towards the open position of FIG. 7. More particularly, the cup 4 of pocket hinge assembly 1 is moved away from and out of engagement with the cabinet plate 2 such that the catch 56 of spring 50 will ride in an opposite direction over and past the cam 38 of link 6. The pivot pin 46 of cup 4 rotates within the coupler 46 of link 6 to carry the cabinet door 60 to the full open position. The cup 4 will continue to rotate with the cabinet door 60 until the base 22 of the cup 4 strikes the swing arm 34 of link 6 (best shown in FIG. 7). That is, the further rotation of the cup 4 of hinge assembly 1 and the door 60 connected thereto will be blocked when the swing arm 36 of link 6 which projects outwardly through the cavity 24 of cup 4 engages the base 22 of the rotating cup 4.

Figure 15:
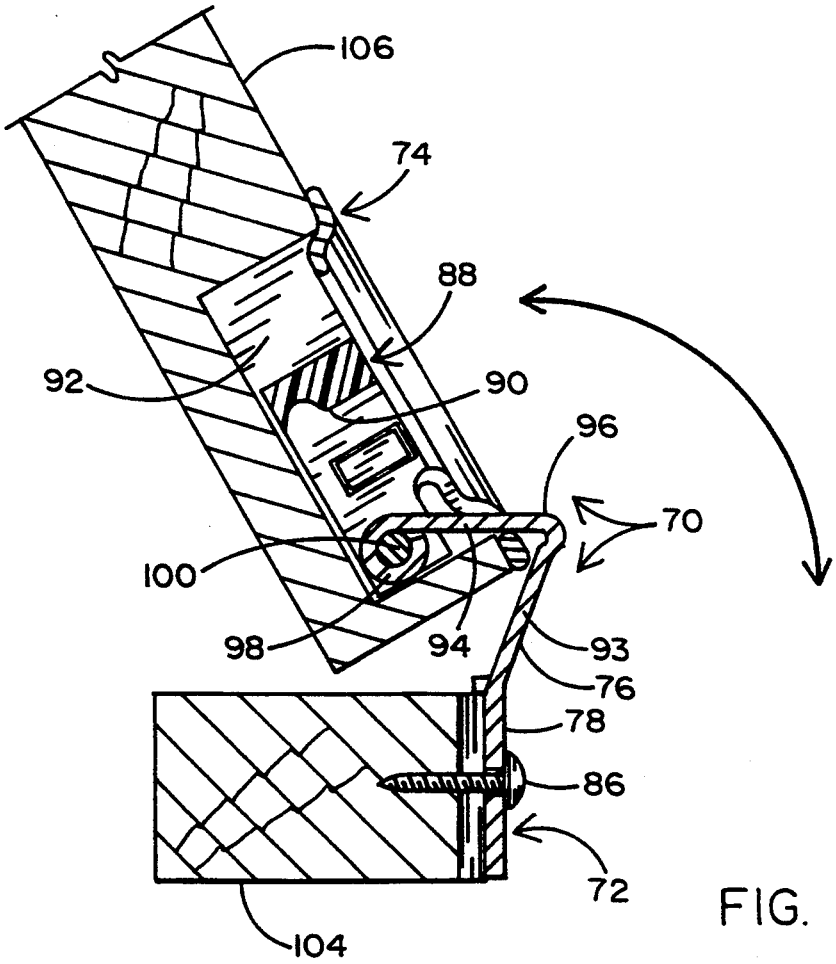
FIG. 15 shows the pocket hinge assembly as installed and rotated to the fully open condition to permit a cabinet door to be opened relative to an associated cabinet.
Figure 16:
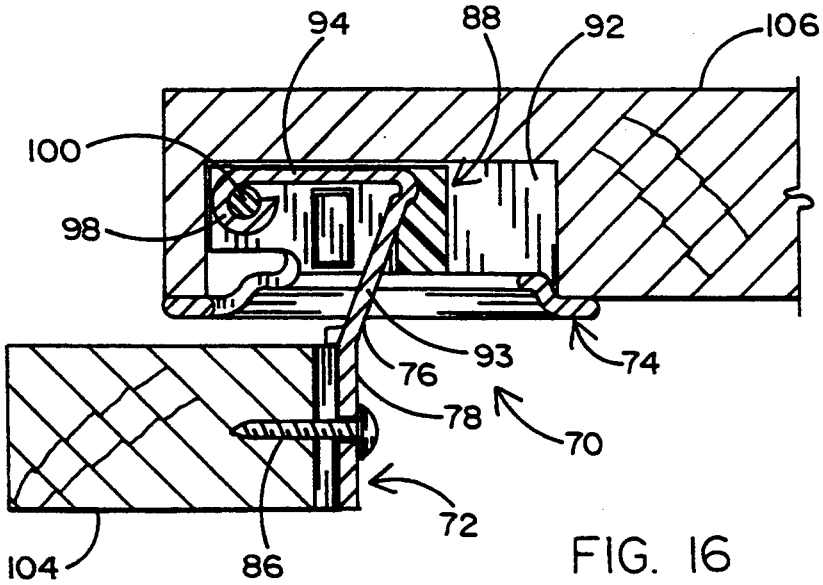
FIG. 16 shows the pocket hinge assembly as installed and rotated to the fully closed condition to permit the cabinet door to be closed across the cabinet.

While the pocket hinge assembly 1 of FIGS. 1–10 is formed from three interconnected pieces (i.e. a cabinet plate 2, a cup 4 and a link 6), FIGS. 11–16 of the drawings show a pocket hinge assembly 70 having only two pieces. More particularly, and referring concurrently to FIGS. 11–14, the pocket hinge assembly 11 of this embodiment includes the combination of a cabinet plate 72 and a cup 74 that are pivotally interconnected with one another by a link 76. Rather than being slidably connected to the cabinet plate as in the case of the hinge assembly 1, the link 76 is coextensively connected to a base 78 of the cabinet plate 72 so as to form a one-piece cabinet plate assembly. However, like the hinge assembly 1 previously described, and as is best shown at FIGS. 15 and 16, the cabinet plate 72 of pocket hinge assembly 70 is mounted on the frame of a cabinet 104, and the cup 74 is mounted within a pocket or similar receptacle formed within the cabinet door 106 so that the door is rotatable between open and closed positions relative to the cabinet.

The cabinet plate 72 of hinge assembly 70 is manufactured from a slightly flexible (e.g. spring steel) material and includes the base 78 having a pair of optional mounting holes 80 located at opposite ends thereof. A pair of gripping teeth 82 bend outwardly from the base 78 to surround the inside corner of the cabinet frame 104 when the pocket hinge assembly 70 is installed in the manner shown at FIGS. 15 and 16. As an important feature of the hinge assembly 70, the base 78 thereof has a generally arcuate configuration. Thus, in the installed configuration, the opposite ends of the base 78 will engage the cabinet frame 104, while the intermediate portion of base 78 will bend outwardly and be spaced from the cabinet frame 104. An elongated adjustment slot 84 is formed through the base 78 to receive an adjustment screw 86 therethrough for attaching the cabinet plate 72 to the cabinet frame 104. The advantages of the arcuate base 78 and elongated adjustment slot 84 of pocket hinge assembly 70 will soon be described.

The cup 74 of pocket hinge assembly 70 is identical to the cup 4 of the hinge assembly 1 of FIGS. 1–10. Moreover, a one-piece, slightly flexible spring 88 having a genrally C-shape, which is carried by the cup 74, is also identical to the spring 70 of hinge assembly 1. Therefore, for purposes of efficiency, the details of cup 74 and spring 88 of hinge assembly 70 will not be described again. Briefly, however, an integral catch 90 is located at and projects from the approximate mid-point of the spring 88. The spring 88 is supported within a cavity 92 of the cup 74, such that a pushing force applied to the catch 90 of spring 88 will cause the spring to flex rearwardly through the cavity 92.

The integral link 76 of cabinet plate 72 which pivotally interconnects the cup 74 of hinge assembly 70 to the cabinet plate 72 includes first and second swing arms 93 and 94 which are aligned at approximately 60 degrees and coextensively join together at first ends thereof along a slightly raised, laterally extending cam surface 96. The second end of swing arm 93 is integrally connected to the base 78 of cabinet plate 70 so that the link 76 and the base 78 form a one-piece cabinet plate 72, as previously described. The second end of swing arm 94 is bent into a cylindrical coupler 98 that is wrapped around a pivot pin 100 which extends through the cavity 92 and between side walls of the cup 74 (best shown in FIG. 14). Accordingly, a rotation of the cup 74 will correspondingly cause the pivot pin 100 to rotate within the coupler 98 of link 76. In this manner, the cabinet door 106, to which the cup 74 of hinge assembly 70 is connected is rotated relative to the cabinet frame 104, to which the cabinet plate 72 is connected, so that the door 106 may swing between the open (best shown in FIG. 15) and closed (best shown in FIG. 16) positions.

The manner in which the pocket hinge assembly 70 permits the cabinet door 106 to move between the open and closed positions relative to the cabinet frame 104 is identical to that previously described when referring to the hinge assembly 1 of FIGS. 1–10. Briefly, however, as the cup 74 of hinge assembly 70 rotates with the door 106 towards the cabinet frame 104, the link 76 of cabinet plate 72 is rotated into the cavity 92 of cup 74. Accordingly, the catch 90 of the C-shaped spring 88 within the cavity 92 will be engaged by the cam 96 of the link 76. The impact of the catch 90 against the cam 96 applies the aforementioned pushing force to catch 90. Therefore, the spring 88 will be flexed or stressed from its normally relaxed position.

In the fully closed position of pocket hinge assembly 70 as shown in FIG. 16, the catch 90 of the spring 88 is carried by the cup 74 so as to ride over and past the cam 96 of link 76. The spring 88 will automatically return to its normally relaxed or unstressed position such that the catch 90 thereof will snap into releasable engagement with the swing arm 93 of link 66 immediately behind and in contact with the cam 96. The engagement of the cam 96 with the catch 90 advantageously functions as a positive lock to hold the cabinet door 106 closed until a suitable pulling force is applied to rotate the cup 74 and the door 106 away from the cabinet plate 72 and the cabinet frame 104, such that the catch 90 of spring 88 will ride in an opposite direction over and past the cam 96 of link 76 until the door is rotated to the fully opened position (of FIG. 15).

However, in the event that the cabinet door 106 is not square and/or the wood is warped such that a misalignment may occur between the frame 104 and door 106, an adjustment thereto may be required to compensate for such misalignment. Such adjustment may be required after the pocket hinge assembly 70 has already been installed. By virtue of the present invention, the position of the door 106 relative to the frame 104 may be quickly and easily adjusted at the cabinet plate 72. More particularly, the cooperation of the adjustment screw 86 with the arcuate base 78 of cabinet plate 72 permits corresponding adjustments to the pocket hinge assembly 70 over a wide range compared with conventional pocket hinge assemblies. That is, the hinge assembly 70 may be adjusted in a first direction by relocating the Cabinet plate 72 vertically along the cabinet frame 104 such that the adjustment screw 86 slides through the adjustment slot 84 formed in the base 78 of cabinet plate 72 (best illustrated in FIG. 13). The hinge assembly 70 may also be adjusted in a second, perpendicularly aligned direction by tightening the adjustment screw 86 downwardly (or loosening screw 78 upwardly) towards the cabinet frame 104 so as to cause the arcuate base 78 of cabinet plate 72 to flatten against the frame (designated 104-1 and shown in phantom lines in FIG. 14). Once the cabinet plate 72 is properly positioned on the frame 104, mounting screws may be installed through the optional mounting holes 80 thereof.

In this regard, the base 78 of cabinet plate 72 has the attributes of a spring which is normally biased in a relaxed, arcuate configuration above cabinet 104, but may be compressed to a stressed, relatively flat configuration against cabinet 104 by simply tightening the adjustment screw 86. If screw 86 is loosened, the spring-like base 78 will automatically return to its arcuate configuration in spaced alignment with the cabinet frame 104. Thus, it may be appreciated that the aforementioned adjustments may be made to move the cabinet door 106 in two perpendicular directions relative to the cabinet frame 104 by means of a single adjustment screw 86 cooperating with a one-piece cabinet plate 72 of the pocket hinge assembly 70 of this embodiment.

It will be apparent that while a preferred embodiment of the invention has been shown and described, various modifications and changes may be made without departing from the true spirit and scope of the invention. Having thus set forth a preferred embodiment of the invention, what is claimed is:

1. A hinge assembly to connect a cabinet door to a cabinet, said hinge assembly comprising:

a cabinet plate to be connected to the cabinet;

a door plate to be connected to the door;

linking means pivotally interconnecting said cabinet plate to said door plate to permit said door plate to rotate relative to said cabinet plate, said linking means having a raised cam surface; and locking means carried by said door plate and adapted to move into engagement with the raised cam surface of said linking means when said door plate rotates toward said cabinet plate and the cabinet door correspondingly moves to a closed position across the cabinet, said locking means cooperating with said cam surface for preventing said door plate from rotating away from said cabinet plate to thereby retain the cabinet door in said closed position, said locking means comprising a normally relaxed spring that is stressed by the cam surface of said linking means when said door plate rotates toward said cabinet plate and said spring engages said cam surface, said spring moving with said door plate out of engagement with said cam surface at which to return to its normally relaxed configuration and thereby block said door plate from rotating away from said cabinet plate, said spring being formed from a flexible material and having first and second legs, a body extending between said legs, and a catch projecting from said body to receive a pushing force applied thereto by the cam surface of said linking means to cause said normally relaxed spring to be stressed.

2. The hinge assembly recited in claim 1, wherein said door plate has a recessed pocket surrounded by a pair of opposing sidewalls to be received in a receptacle formed in the cabinet door, said spring located within said pocket of said door plate such that the first and second legs of said spring are fixedly connected to respective side walls of said pocket to enable the body of said spring to flex relative to said legs.

3. The hinge assembly recited in claim 2, wherein a first end of said linking means is connected to said cabinet plate and the opposite end of said linking means is coupled to a pivot pin extending between said side walls of the pocket of said door plate, said door plate rotating relative to said cabinet plate at said pivot pin.

4. The hinge assembly recited in claim 3, wherein the connection of said first end of said linking means to said cabinet plate is slidably adjustable therealong.

5. The hinge assembly recited in claim 1, wherein said spring is a single piece of flexible material having a generally C-shape, the legs of said spring turning towards one another from said body.

6. The hinge assembly recited in claim 1, wherein a first end of said linking means is fixedly coupled to said door plate at a pivot pin attached thereto such that said door plate is rotatable relative to said cabinet plate at said pivot pin, and the opposite end of said linking means being adjustably connected to said cabinet plate.

7. The hinge assembly recited in claim 6, wherein the opposite end of said linking means has a first slot formed therethrough and the cabinet plate has a second slot axially aligned with said first slot, said hinge assembly further comprising a fastener extending through said first and second slots to permit said opposite end to be slidably adjusted along said cabinet plate.

8. A hinge assembly to connect a cabinet door to a cabinet, said hinge assembly comprising:

a cabinet plate to be connected to the cabinet, said cabinet plate formed from flexible spring material and being curved so as to extend from a location against said cabinet to a location spaced from said cabinet;

means by which to urge said curved cabinet plate towards said cabinet to flatten said cabinet plate against said cabinet and thereby adjust the position of the cabinet door relative to the cabinet;

a door plate to be connected to the cabinet door;

linking means pivotally interconnecting said cabinet plate to said door plate to permit said door plate to rotate relative to said cabinet plate; and locking means carried by said door plate and adapted to move into engagement with said linking means when said door plate rotates toward said cabinet plate and the cabinet door correspondingly moves to a closed position across the cabinet, said locking means preventing said door from rotating away from said cabinet plate to thereby retain the cabinet door in the closed position.

9. The hinge assembly recited in claim 8, wherein said linking means has a raised cam surface projecting therefrom, said locking means engaging said cam surface when said door plate rotates toward said cabinet and said cabinet door moves towards said closed position, said locking means comprising a normally relaxed spring that is stressed when engaged by the cam surface of said linking means as said door plate rotates towards said cabinet plate, said spring moving out of engagement with said cam surface so as to return to its normally relaxed condition at which to block the door plate from rotating away from said cabinet plate, said spring including first and second legs, a body connected between said legs, and a catch projecting from said body to receive a pushing force applied thereto by the cam surface of said linking means to cause said normally relaxed spring to be stressed.

10. The hinge assembly recited in claim 9, wherein said spring is formed from a single piece of flexible plastic having a spring memory.

11. The hinge assembly recited in claim 10, wherein said flexible plastic is "DELRIN".

12. The hinge assembly recited in claim 9, wherein said spring has a generally C-shape, the legs of said spring turning towards one another from said body and said catch projecting from said body at a location between said legs.

13. The hinge assembly recited in claim 8, wherein said cabinet plate is integrally connected to said linking means to form a single continuous piece therewith.

14. The hinge assembly recited in claim 8, wherein the means to urge said curved cabinet plate towards the cabinet includes an adjustment screw extending through said cabinet plate and attached to said cabinet, said adjustment screw adapted to be tightened against the curved cabinet plate to flatten said cabinet plate against said cabinet.

15. The hinge assembly recited in claim 14, further comprising an elongated adjustment slot formed in said cabinet plate for receiving said adjustment screw therethrough, said cabinet plate being movable along said cabinet for causing said adjustment screw to slide through said slot.

16. The hinge assembly recited in claim 9, wherein said door plate has a recessed pocket surrounded by a pair of opposing side walls to be received in a receptacle formed in the cabinet door, said spring located within the pocket of said door plate such that the first and second legs of said spring are fixedly connected to respective side walls of said pocket to enable the body of said spring to flex relative to said legs when a pushing force is received by said catch.

17. The hinge assembly recited in claim 16, wherein said linking means has first and opposite ends, the first end of said linking means connected to said cabinet plate and the opposite end of said linking means coupled to a pivot pin extending between said side plates surrounding the pocket of said door plate, said door plate rotating relative to said cabinet plate at said pivot pin.

* * * * *